US006966166B2

(12) United States Patent
Kissling

(10) Patent No.: US 6,966,166 B2
(45) Date of Patent: Nov. 22, 2005

(54) HIGH-SPEED CONTINUOUS ACTION FORM-FILL-SEAL MACHINE AND METHODS

(75) Inventor: Etienne Kissling, Reedley, CA (US)

(73) Assignee: SWF Companies, Inc., Reedley, CA (US)

( * ) Notice: Subject to any disclaimer, the term of this patent is extended or adjusted under 35 U.S.C. 154(b) by 0 days.

(21) Appl. No.: 10/810,482

(22) Filed: Mar. 26, 2004

(65) Prior Publication Data

US 2004/0187442 A1 Sep. 30, 2004

Related U.S. Application Data

(60) Provisional application No. 60/457,645, filed on Mar. 27, 2003.

(51) Int. Cl.[7] ..... B65B 9/20

(52) U.S. Cl. ..... 53/451; 53/551

(58) Field of Search ..... 53/451, 551, 553, 53/554, 555

(56) References Cited

U.S. PATENT DOCUMENTS

| | | | | | |
|---|---|---|---|---|---|
| 3,055,154 | A | * | 9/1962 | Markley et al. | 53/551 |
| 3,451,187 | A | * | 6/1969 | Pitts, Sr. et al. | 53/451 |
| 3,641,737 | A | * | 2/1972 | Tamagni | 53/554 |
| 3,923,084 | A | | 12/1975 | Matthews et al. | |
| 4,004,397 | A | | 1/1977 | Hoffman et al. | |
| 4,007,577 | A | | 2/1977 | Matthews et al. | |
| 4,146,418 | A | | 3/1979 | Walter | |
| 4,175,995 | A | | 11/1979 | Walter | |
| 4,543,770 | A | | 10/1985 | Walter et al. | |
| 4,557,103 | A | | 12/1985 | Schwartz et al. | |
| 4,726,171 | A | | 2/1988 | Kreager et al. | |
| 4,729,210 | A | * | 3/1988 | Galliano | 53/551 |
| 4,730,648 | A | | 3/1988 | Walter | |
| 4,751,805 | A | | 6/1988 | Walter | |
| 4,768,330 | A | | 9/1988 | Lane, Jr. et al. | |
| 4,769,974 | A | | 9/1988 | Davis | |
| 4,795,271 | A | | 1/1989 | Lane, Jr. et al. | |
| 4,836,380 | A | | 6/1989 | Walter et al. | |
| 4,845,926 | A | | 7/1989 | Davis | |
| 4,854,466 | A | | 8/1989 | Lane, Jr. | |
| 4,890,744 | A | | 1/1990 | Lane, Jr. et al. | |
| D306,555 | S | | 3/1990 | Lane et al. | |
| 4,924,762 | A | | 5/1990 | Lane, Jr. | |
| 4,961,302 | A | | 10/1990 | Davis | |
| 4,996,819 | A | | 3/1991 | Davis | |
| 4,999,968 | A | | 3/1991 | Davis | |
| 5,016,426 | A | | 5/1991 | Davis | |
| 5,029,430 | A | | 7/1991 | Davis | |
| 5,064,093 | A | | 11/1991 | Davis et al. | |
| 5,076,040 | A | | 12/1991 | Davis | |
| 5,097,993 | A | | 3/1992 | Davis | |
| D333,311 | S | | 2/1993 | Davis | |
| D335,677 | S | | 5/1993 | Davis et al. | |

(Continued)

*Primary Examiner*—John Sipos
(74) *Attorney, Agent, or Firm*—Mark D. Miller

(57) ABSTRACT

This is a high-speed, multi-lane machine and method for the continuous forming, filling and sealing of plastic or film pouches of various sizes commonly used to hold fluids, liquids, and viscous materials or other substances. The machine includes a film roll station, a pump station, a side seal station, a pull wheel station, a cross seal station, and a cross cut station. The invention provides for continuous production of pluralities of pouches without stops or delays by utilizing one or more moveable reciprocating carriages that travel with the flow of film through the machine, the carriages supporting each of the side sealing, cross sealing, and cross cutting stations. Coordination of the various stations is accomplished through electronic computer control, working in conjunction with a plurality of motion imparting devices such as servo motors, cam systems, linkages and the like. The various components of the machine are adjustable so that pouches of various lengths and/or widths may be formed using the same machine.

21 Claims, 9 Drawing Sheets

U.S. PATENT DOCUMENTS 5,224,642 A 7/1993 Davis et al.
D347,993 S 6/1994 Lane, Jr. et al.
D354,906 S 1/1995 Lane, Jr. et al.
D356,015 S 3/1995 Lane, Jr. et al.
5,408,807 A 4/1995 Lane, Jr. et al.
5,430,987 A 7/1995 Lane, Jr. et al.
5,460,844 A * 10/1995 Gaylor ..... 426/394
D366,995 S 2/1996 Davis
5,501,525 A 3/1996 Cox et al.
D372,037 S 7/1996 Lane, Jr. et al.
D375,676 S 11/1996 Davis et al.
5,596,867 A 1/1997 Davis
5,632,416 A 5/1997 Lane, Jr. et al.
5,634,324 A 6/1997 Schmachtel
5,634,572 A 6/1997 Lane, Jr. et al.
D386,194 S 11/1997 Davis
D386,398 S 11/1997 Davis
5,784,863 A 7/1998 Davis
D399,512 S 10/1998 Davis et al.
5,822,958 A 10/1998 Davis
5,921,068 A 7/1999 Fangmeier et al.
5,931,345 A 8/1999 Lane, Jr. et al.
6,006,501 A 12/1999 Davis et al.
6,023,918 A * 2/2000 Czepluch ..... 53/551
6,050,065 A 4/2000 Bonde
6,178,719 B1 1/2001 Hansen
6,179,017 B1 1/2001 Walter
6,179,587 B1 1/2001 Kurth
6,202,384 B1 3/2001 Kurth et al.
6,212,861 B1 * 4/2001 Tsuruta ..... 53/551
6,261,367 B1 7/2001 Donges
6,352,364 B1 3/2002 Mobs
6,442,915 B1 9/2002 Kurth et al.
6,478,041 B1 11/2002 Stede
6,495,111 B2 12/2002 Kurth
6,526,732 B2 3/2003 Liao
6,550,219 B2 4/2003 Liao
D478,276 S 8/2003 Mobs et al.
6,622,457 B2 9/2003 Kurth
D481,744 S 11/2003 Kurth et al.
6,761,016 B1 * 7/2004 Soleri ..... 53/554
2002/0104290 A1 8/2002 Kurth et al.
2002/0139084 A1 10/2002 Tobolka
2002/0170269 A1 11/2002 Liao
2002/0178691 A1 12/2002 Liao
2003/0163979 A1 9/2003 Kurth et al.

* cited by examiner

HIGH-SPEED CONTINUOUS ACTION FORM-FILL-SEAL MACHINE AND METHODS

This application claims the benefit of U.S. Provisional Application No. 60/457,645, filed on Mar. 27, 2003, which is incorporated herein by this reference.

BACKGROUND OF THE INVENTION

1. Field of the Invention

The present invention relates to an apparatus for manufacturing pouches made of webbed plastic, foil or film, and more particularly, to an apparatus for forming, filling and sealing such pouches at a continuous rate.

2. Description of the Prior Art

Webbed pouches (also sometimes referred to as packets or sachets) are commonly used within many industries to package and distribute individual portions of liquids or viscous materials, such as foods, beverages, condiments, pharmaceutical or personal care products, and chemicals. Such pouches are also used to package and distribute other objects or commodities, such as candy, nuts, salt, pepper, and the like. The widespread popularity of such pouches, and their ease of distribution, has led in a heightened interest in machines and methods for forming, filling and sealing such pouches.

The traditional apparatus for manufacturing webbed pouches comprises two rolls for dispensing sheets of webbed film, foil or plastic of equal dimensions, a plurality of sealing devices appropriate for such film, and means for inserting the contents into the film pouches. The apparatus first receives film from the dispensers, and aligns their respective edges. The sealing devices are then applied to all but one of the edges, forming a pouch with a cavity and opening. The contents (liquids, viscous materials or other substances) are inserted into the cavity through the opening. The opening is then sealed and separated from the film. The process is then repeated.

However, such a traditional apparatus is generally unsuitable for manufacturing large volumes of film pouches at very high speeds. Specifically, the traditional process necessitates a certain delay or pause in the flow of film through the machine, since the machines must stop during every cycle while the side and/or leading and trailing edges of the pouches are pressed and sealed, and when rows of sealed pouches are cut free following their formation. Failing to press and seal the edges properly can result in weakened film pouches, causing such pouches to leak or burst. Even if the delay (i.e., stop) is only for a few milliseconds per cycle, the accumulation of stops over time translates into significantly decreased output and hence decreased revenue for the manufacturer utilizing such an apparatus.

Various devices have been developed to increase the production rate of such film pouches. For example, U.S. Pat. No. 4,726,171 utilizes a vertically moving combination advancement-sealing-separation mechanism that travels between various locations within the apparatus, advancing the film from the film roll, sealing the ends of a pouch, or separating a pouch from the fill, depending upon the particular engagement point. U.S. Pat. Nos. 4,004,397 and 6,178,719 both utilize rotary presses and sealers to minimize delays in the pouch manufacturing process.

Unfortunately, none of these devices are particularly suited for very high-volume production of film pouches. The '171 device does not disclose an apparatus capable of continuous and uninterrupted production, in that the film advancement is temporarily paused while the combination mechanism separates the previous pouch from the film, and resumes only after the mechanism returns to its initial position to receive a subsequent pouch from the sealing heater. Such pause, even if only for a few milliseconds per cycle, results in a noticeably decreased daily output volume for the device. The same is true for the device of U.S. Pat. No. 5,634,324. The '397 and '719 devices require substantial operational floor space, which may not be readily available in some settings. Furthermore, these devices provide a limited amount of time in which to press and seal the pouch edges, increasing the likelihood that the pouch will leak or burst.

It is therefore desirable to provide an apparatus for forming, filling and sealing large volumes of film pouches within a minimal amount of time. It is further desirable that such film pouches be manufactured at a continuous and uninterrupted rate so as to maximize production volume. It is further desirable that the apparatus be capable of simultaneously manufacturing a plurality of film pouches, so as to further maximize production volume. It is further desirable that the apparatus utilizes a minimal amount of operational floor space. It is further desirable that the film pouches produced be not overly susceptible to leakage or breakage.

SUMMARY OF THE INVENTION

The present invention is a high-speed, multi-lane method and apparatus for the continuous forming, filling and sealing of webbed film, plastic or foil pouches or sachets of various sizes commonly used to hold fluids, liquids, viscous materials (e.g. ketchup, honey, salsa, etc.) or other substances. The invention is made up of the following discrete stations: a film roll station; a pump station; a side seal station; a pull wheel station; a cross seal station; and a cross cut station. The invention provides for continuous production of pluralities of pouches or sachets without stops or delays by utilizing one or more moveable reciprocating carriages that travel with the flow of film through the machine, the carriages independently supporting each of the side sealing, cross sealing, and cross cutting apparatus. Coordination of the various stations is accomplished through electronic computer control (e.g., PLC), working in conjunction with a plurality of motion imparting devices such as servo motors, cam systems, linkages and the like. The various components of the machine are adjustable so that pouches of various lengths and/or widths may be formed using the same machine.

A pair of film rolls is provided at the film roll station. Film is removed from each roll and used to form the fronts and backs, respectively, of the pouches. Sheets of film from both rolls are advanced through the apparatus by the pull-wheel station. The film from each roll is guided so that the two sheets of film are in close proximity to, and in a parallel relationship with, one another when they are advanced through the machine.

The pump station comprises of a plurality of fill dispensers in communication with a storage structure containing the fluid or other material to be inserted into the pouches. These dispensers are capable of drawing a pre-determined quantity of material from a reservoir and depositing it into the cavities of the film pouches formed by the machine. In the preferred embodiment, the pump station and dispensers may be driven by one or more motion-controlled servomotors in communication with the cam system. The quantity of material may be changed by exchanging the dispensers (with different dispensers having more or less capacity), changing the stroke of the pump cycle, changing the timing of the pump cycle, and the like. This allows for different quantities of materials to be dispensed depending upon the size and capacity of the pouches to be formed by the machine.

In one embodiment, a servo motor or motors translate a rotary motion of the motor and gearbox into a linear motion through a belt and pulley system, into a gear rack and pinion gear, in a vertical arrangement, which allow the pumping pistons to move in a linear up and down motion. This linear vertical motion of the pistons allow product to enter the cylinder body of the pump station, and through a reversal of this vertical motion of the pistons the product is expelled into fill tubes which, in turn, dispense the product into the pouches. The servo motor allows the motion of these pistons to be controlled very precisely by which the product flow is controlled and the amount can be varied by increasing or decreasing the stroke length of the piston. An electronic signal may be given to each of the side seal, cross seal and knife stations to vary the length of the pouch or sachet to match the amount of product being dispensed.

The quantity of material deposited into the film pouches is communicated to the pump station by entering a setting into the electronic controller which in turn communicates these settings to the individual stations and motion imparting system (cam system or servo motors) of the individual stations and adjusts their movement accordingly.

The side seal station comprises of two opposing sealing frames, both positioned in such a manner that the films advance between the opposing frames. A plurality of linearly oriented sealing pads, each pad having a heating element, are affixed to each frame forming a plurality of pairs of pads. Each sealing pad is in close proximity to a corresponding pad on the opposing frame, and is elongated along the path of the film through the machine (usually a vertical elongation). Each pair of opposing pads is situated so as to apply pressure to the films between them, causing the contacted surface areas of such films to be pressed together and sealed. The side seal station is capable of movement along the film path in a cyclical oscillating fashion, as described herein. This reciprocating movement allows the side seal station to travel with and seal the film while it is moving through the machine without requiring any momentary stop in the flow of film through the machine. The side seal station travels along the flow path of the film and forms a plurality of seals while traveling. Once the seals are formed, the opposing sealing pads are retracted, and the side seal station quickly reciprocates back along the film flow path and again travels along the path to form the next set of seals, and so on, in a cyclical fashion. This movement may be driven by one or more motion-controlled servomotors, with or independent from a cam system.

The pull wheel station comprises two opposing rotatable roller shafts, both positioned in such a manner that the film advances between the opposing shafts. A plurality of linearly oriented (typically vertical) retractable rollers are affixed to each shaft such that pairs of opposing rollers are provided. The shafts may be retracted so that the two sheets of film may be fed between them. When the shafts are in a closed position, pressure is exerted on the rollers of each pair so that they come into contact with each other, pinching the film between them. This provides gripping friction upon the film surfaces so that the films may be pulled through this station. The pull wheel station may be driven by one or more motion-controlled servomotors, with or independent from a cam system.

The cross seal station comprises an opposing pair of sealing pads, extending across the film path (usually in a horizontal orientation), positioned in such a manner that the film advances between the opposing pads. These pads are in close proximity to one another, and capable of closing to apply pressure to the films between them, causing the particular contacted surface areas of such films to be pressed together and sealed. The cross seal station is mounted such that it is capable of movement along a defined portion of the film path in a reciprocating or oscillating fashion, as described herein. This reciprocating movement is independent from that of the side seal station, and allows the cross seal station to travel with and seal the film while it is moving through the machine without requiring any momentary stop in the flow of film through the machine. The cross seal apparatus travels along the flow path of the film and forms a cross seal while traveling. Once the seal is formed, the sealing pads are retracted, and the cross seal station quickly reciprocates back along the flow path and again travels along the path to form the next seal, and so on, in a cyclical fashion. The cross seal station may also be driven by one or more motion-controlled servomotors, with or independent from a cam system.

The cross cut station comprises a cutting implement positioned to receive the film from the cross seal station. The implement is capable of separating each row of film pouches by cutting along the midpoints of the horizontal sealed surface areas created by the cross seal station above. The cross cut station is also capable of movement along a defined portion of the film path in a reciprocating or oscillating fashion in the same manner as, but independent from, the side and cross seal stations, as described herein.

In the preferred embodiment, each of the side seal, cross seal and cross cut stations are operated by different computer controlled motors, such as servo motors. However, each of these stations may alternatively be operated using a cam system, each such cam system having a single servo motor for operation. Each such cam system may comprise a combination of cams, servomotors, gears, pulleys, levers and/or linkages, or combinations thereof The same cam system may be used to control movement of each of the side seal station, pull wheel station, cross seal station and cross cut station. Alternatively, one or more separate cam systems may be provided in order to impart independent movement to any one or more of these stations.

The flexibility and independence of the various stations permits the operator to adjust the machine to create pouches having different fluid capacities, different lengths and different widths (i.e. horizontal and vertical dimensions). These definitions are established by adjusting such things as the quantity of material pumped into the pouches, the number and spacing of the side seals (defining the number of pouches per row), the length of the side seals and the frequency of cross seals (defining the length of the pouches), the oscillation patterns of each of the three moving stations (i.e., the side seal, cross seal and cross cut stations), the movements of the servomotors and/or cams, the gear and pulley ratios of the system, etc.

In use, two sheets of film in close proximity to each other are pulled from two large film rolls through the side seal station by the rollers of the pull wheel station. The two films are parallel to, and in close proximity with, one another, such that the first film may form, for example, the fronts of the pouches, while the second forms the backs thereof. Activation of the pull wheel station causes the rollers to advance the films from the film rolls. This activation may alternatively be communicated to the cam system through the rotation of the pull wheel rollers. Before the films are pulled through the side seal station, they pass along either side of a plurality of fill tubes used to deposit the fluid content of the finished pouches. Thus, the side seals are formed around the fill tubes.

At the longitudinal or side seal station, a plurality of pairs of longitudinally elongated heated sealing pads in this station come together and apply pressure upon the contacted film surfaces areas, causing the affected surfaces to adhere to one another in continuous vertical strips, thereby defining cavities between the continuous strips. The number and width of these cavities is determined by the distance between the elongated heated sealing pads. Each of these cavities surrounds one of the fill tubes.

The side seal station travels along the film path as it seals the films together, forming a plurality of continuous longitudinal cavities or tubes of film. The speed of travel of the side seal station along the film path is determined by computer control and/or communication from the cam system, and is consistent with the film speed. This allows the opposing pads of the side seal station to maintain constant pressure upon the affected film surface area for a sufficient time to bond the two sides of film together at such area. Once the film and side seal station arrive at an adjustably designated release point, the opposing pads release the film. The sealed film, now in the form of a plurality of tubes, continues to the pull wheel station, while the side seal station returns to its initial receiving point to begin a subsequent cycle. Such release and return occur without affecting or limiting the continuous movement of the film. It is to be appreciated that the position of the release point may be adjusted according to the length of the side seals, the overlapping of the sealed areas, the desired length of the plurality of tubes to be formed, and other factors. It is to be appreciated that during subsequent cycles, there is a slight overlap of the heating pads of the side seal station over the previously created side seals in order to provide continuous side seals on the films.

A plurality of blades are provided along the film path just ahead of the pull station, with one blade ahead of each pull wheel (pair). These blades are positioned at the mid-points of each of the freshly created side seals, and separate the two sealed film sheets into a plurality of individual tubes or strips as they are pulled through the pull wheel station. These separated tubes are then transferred to the cross seal station.

The sealing pads of the cross seal station are mounted perpendicularly to those of the side seal station (usually horizontally). These cross sealing pads apply heat and pressure to the film across a transverse section of the surface area, causing the affected surfaces to adhere to one another in a perpendicular relationship to the continuous longitudinal tubes formed by the side seal station. In the first cycle, such perpendicular adhesion defines the leading edge of a row of individual film pouches. In subsequent cycles, each such perpendicular adhesion defines both the trailing edge of the pouches of the current cycle, as well as the leading edge of the pouches of the subsequent cycle. As the sealing heat and pressure is applied, the cross seal station moves along the film path at a predetermined computer controlled rate of speed that is consistent with the film speed.

The cross seal station must maintain heat and pressure upon the affected film surface area for a sufficient time to complete the transverse cross seal. It is to be appreciated that this length of time (and hence, the cycle time for the cross seal station) may be different from that of the side seal station. Once a cross seal is formed, the pre-measured contents of the pump station storage structure are then deposited into the cavities of the film pouches through the fill tubes.

When the cross seal station arrives at an adjustably pre-determined release point, the pads are retracted and the film is released continuing to the cross cut station. Meanwhile, the cross seal station returns to the initial receiving point to begin a subsequent cycle. Such release and return are accomplished without affecting the continuous movement of the film through the machine. The top edge of the current row of film pouches is sealed by the cross seal imparted in the subsequent cycle, which also seals the bottom edge of the pouches of the subsequent cycle. It is to be appreciated that the position of the release point may be adjusted according to the desired length of the tubular film strips between cross seals, or other factors.

The cross cut station separates a row of individual film pouches from the film by cutting the pouches along the midpoint of the cross seal. The side seals between the now-filled tubes of the row were previously cut by the plurality of blades ahead of the pull station. Following the cross cut, the individual pouches then exit from the machine into a hopper or other appropriate receptacle.

It is therefore a primary object of the present invention to provide methods and apparatus for forming, filling and sealing large volumes of film pouches in a minimal amount of time.

It is another primary object of the present invention to provide methods and apparatus to form and fill film pouches in a continuous and uninterrupted fashion so as to maximize the volume of production.

It is another object of the present invention to provide methods and apparatus capable of simultaneously manufacturing a plurality of filled film pouches, so as to further maximize the volume of production.

It is another object of the present invention to provide an apparatus that utilizes a minimal amount of operational floor space.

It is another object of the present invention that the apparatus apply the least amount of stress to the film to avoid deformation of pouches.

It is another objective of the present invention to form film pouches that are not overly susceptible to leakage or breakage.

Additional objects of the invention will be apparent from the detailed description and the claims herein.

DETAILED DESCRIPTION

Figure 1:
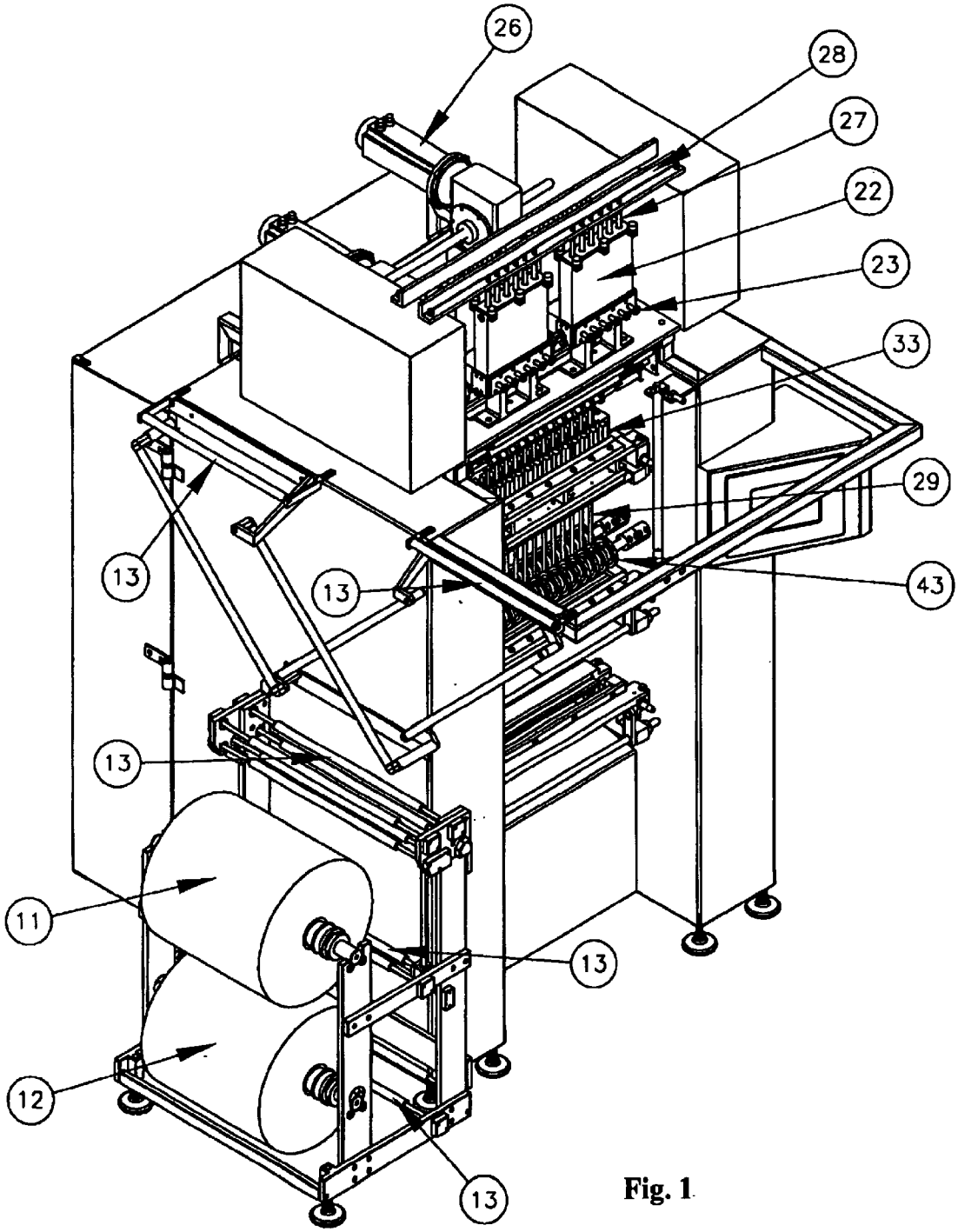
FIG. 1 is an isometric view of the present invention.
Figure 2:
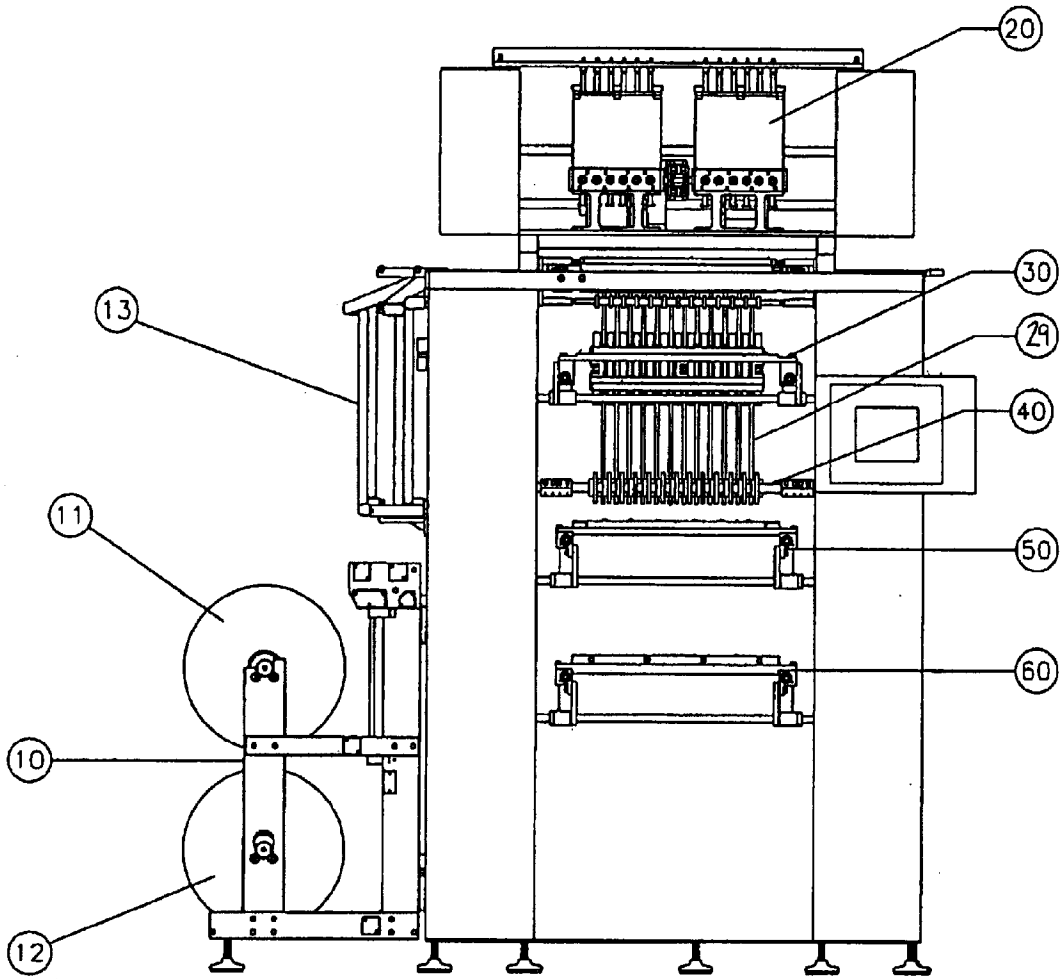
FIG. 2 is a front plan view of the present invention.
Figure 3:
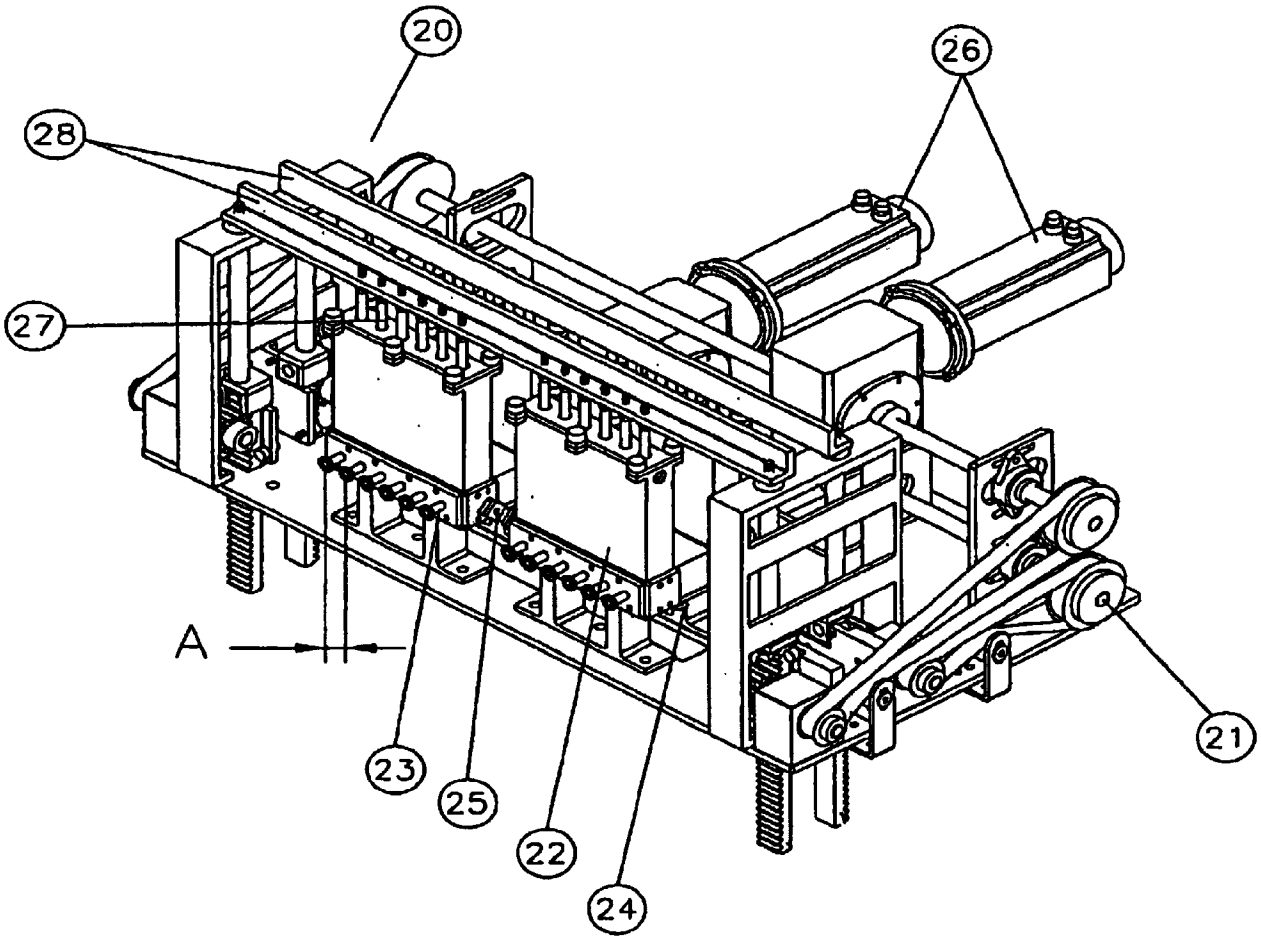
FIG. 3 is an isometric view of a typical pump station of the present invention.

Referring to the drawings wherein like reference characters designate like or corresponding parts throughout the several views, and referring particularly to FIGS. 1 and 2, it is seen that the apparatus of the present invention includes a film roll station, generally 10, for providing films to the apparatus; a pump station, generally 20, for inserting preferably fluids (liquids, viscous materials) or other substances into the cavities of the individual film pouches; a side seal station, generally 30, for forming the sides of the individual pouches; a pull wheel station, generally 40, for advancing the films through the machine; a cross seal station, generally 50, for sealing the leading and trailing edges of the pouches; and a cross cut station, generally 60, for separating rows of individual pouches from the film. In the preferred embodiment, motors, preferably servo motors, are used to operate the various stations. In an alternative embodiment, cam systems 70 such as that shown in FIG. 9 may be used to operate one or more of the stations.

As depicted in FIGS. 1 and 2, a first film roll 11 and a second film roll 12 are rotatably mounted on the machine, preferably such that the film two sheets of film that unroll therefrom are in parallel relationship to each other. The film from each roll is pulled by the rollers 43 of the pull wheel station 40 (depicted in FIG. 6). The operation of rollers 43 of pull wheel station 40 causes sheets of film from each roll 11 and 12 to be released at an equal and constant rate of speed. The first roll 11 provides film for the first (e.g. front) surfaces of the pouches or sachets to be formed, while the second roll 12 provides film for the second (e.g. back) surfaces thereof.

Alignment devices such as rollers 13 are provided to properly position the sheets of film coming off rolls 11 and 12. The alignment mechanism comprises a plurality of angled rollers and guides 13 positioned to receive the films from rolls 11 and 12. In the illustrated example, the film from roll 11 is guided to the front main body of the present invention, while the film from roll 12 is guided to the rear main body of the present invention. As the films are received into the side seal station 30 of the main body, they are parallel to, and in close proximity with one another. It is to be appreciated that any appropriate set of guides and rollers 13 may be used to route the two film layers into the machine in close parallel proximity, and that, for example, film from the roll 11 may be routed to back of the machine, and film from roll 12 may be routed to the front of the machine. Alternatively, the films from each roll may be routed to other appropriate places (e.g., a set of three 45 degree rollers), depending upon the overall configuration of the machine, so long as the films are eventually placed into close parallel proximity with each other.

Figure 4A:
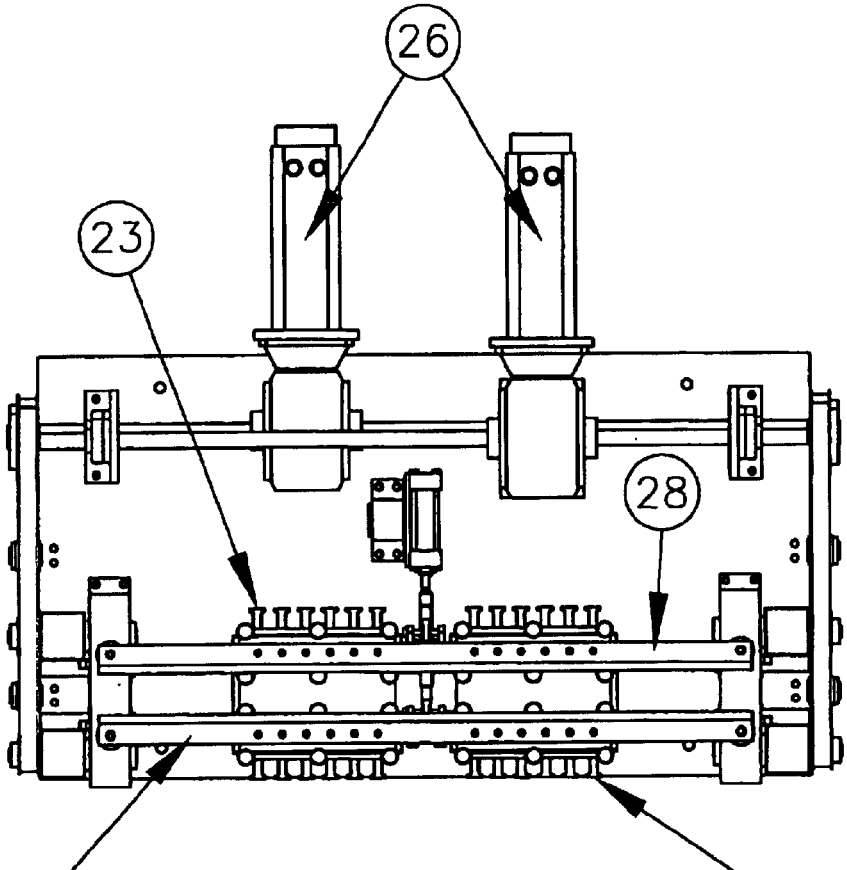
FIG. 4A is a top plan view of a typical pump station of the present invention.
Figure 4B:
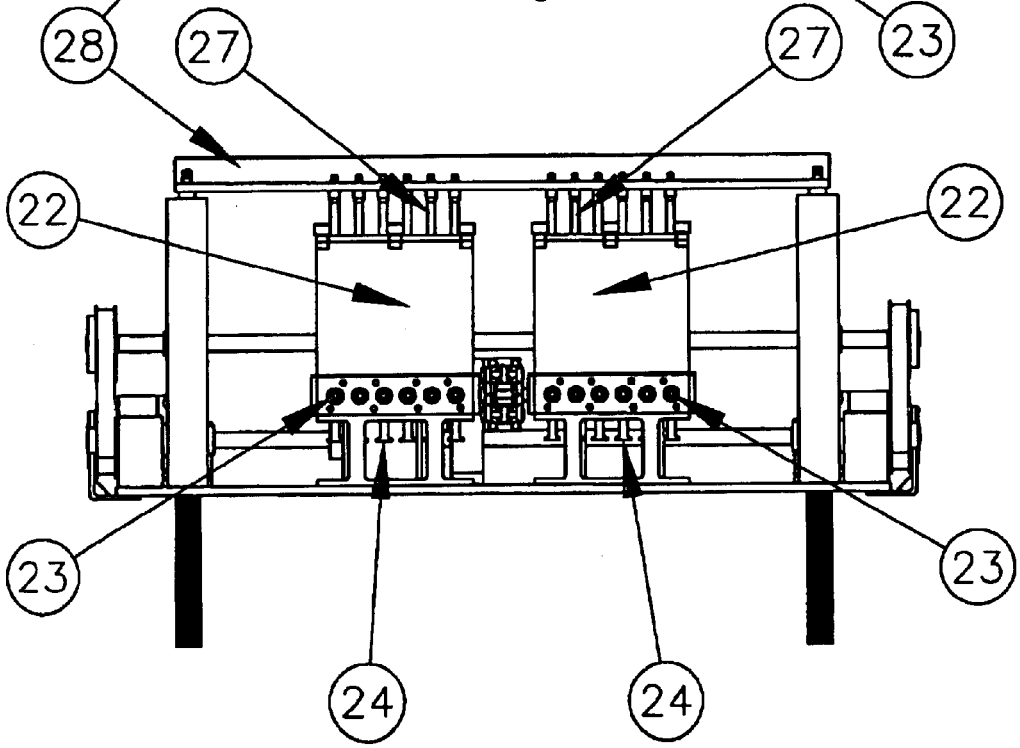
FIG. 4B is a side elevational view of the pump station of FIG. 4A.

As depicted in FIGS. 2 and 4A/4B, it is seen that pump station 20 comprises of at least one product dispenser 22, each such dispenser 22 having a plurality of input nozzles 23 attached thereto for receiving the fluid product material (e.g. ketchup) from a reservoir (not shown). In the illustrated embodiment, four such dispensers 22 are provided. A set of output nozzles 24 are provided on the underside of station 20, such nozzles 24 preferably being shared by two dispensers 22 in alternating fashion (described below) for discharging fluid product into the individual film pouches formed by the machine. A fill tube 29 is attached to each nozzle 24 to deposit the fluid product material into each pouch formed according to the number of seals in the side seal station 30 described below. Fill tubes 29 extend between the film sheets through side seal station 30, and terminate between and below pull rollers 43 as best shown in FIGS. 1 and 2.

For each dispenser 22, the input nozzles 23 and output nozzles 24 are affixed in particular locations, with particular distances between them (indicated by range A), according to the width and number of pouches to be formed, such that the fill material is dispensed through the respective fill tubes 29 into the cavities of the film pouches formed below. For different sized pouches, different dispensers 22 may be employed having different distances A between their respective input and output nozzles. Other materials, such as sugar, salt, crushed nuts or the like, may be also be dispensed from the fill station 20 by substituting different dispensers 22 and nozzles 23, 24.

In the preferred embodiment, the pumping of materials through pump station 20 is accomplished using servo motors 26 in conjunction with pistons 27 attached to plates 28. A plurality of valves (e.g. rotary cutoff valves, not shown) are provided inside dispenser 22, one valve for each output nozzle 24. In a first position, these valves allow fluid product material to enter a dispenser 22 through nozzles 23, and in a second position said valves allow such material to exit through nozzles 24. Pairs of dispensers 22 are provided so that every stroke of pistons 27 (whether up or down) in conjunction with the valves causes action in both of the dispensers 22 of the pair: during a given stroke, one dispenser 22 of the pair is filled with a measured amount of product from the reservoir through nozzles 23, while the contents of the other dispenser 22 of the pair are discharged through exit nozzles 24. During the next stroke, the first dispenser 22 discharges its contents while the second dispenser is filled, and so on, in alternating fashion. In this way, there is a constant filling action with every piston stroke. This facilitates the continuous uninterrupted progress of film through the machine.

One or more movable lever members 25 are attached to each dispenser 22 for operating the internal valves. Air cylinders, cams or other means may be used for coordinated movement of members 25. In one embodiment, pistons 27 may be attached to and controlled by cross bars 28 which are moved up and down by a set of gears and racks which are driven, in turn, by timing belts attached to a servo drive output shaft 21. In an alternative embodiment, a cam device and linkages may be employed to operate the pistons and valves instead of servo motors.

Figure 5:
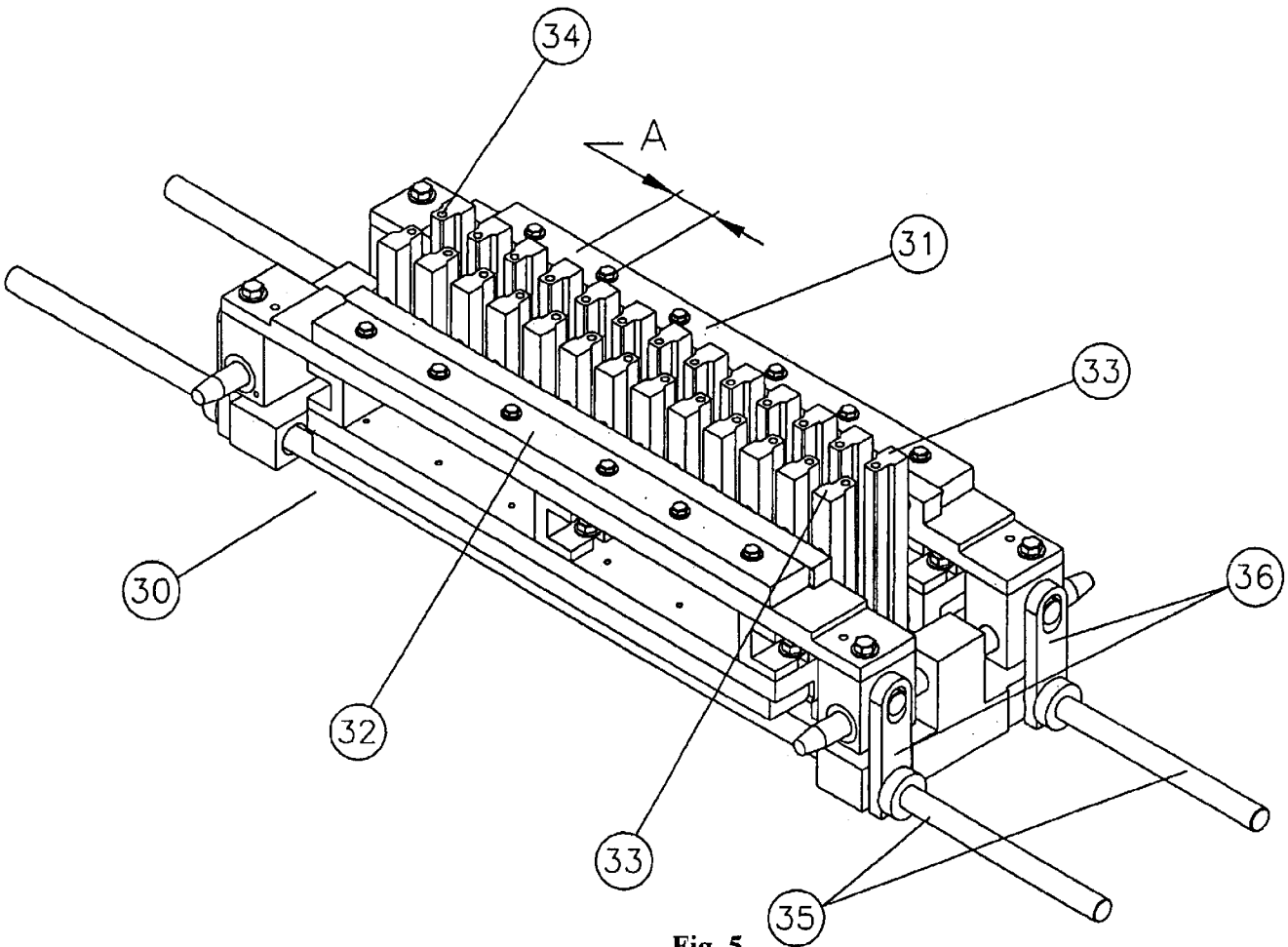
FIG. 5 is an isometric view of a typical side seal station of the present invention.

As depicted in FIG. 5, the longitudinal or side seal station 30 includes a first sealing frame 31 and an opposite second sealing frame 32, both positioned in such a manner that the two films advance between the first 31 and second 32 frames. A plurality of vertically oriented sealing pads 33 are affixed to each frame 31, 32 such that pairs of such pads are positioned directly across from each other, one pad from each pair being provided on frame 31, and the other pad of the respective pair being found on frame 32. The parallel sheets of film from rollers 11 and 12 pass between frames 31 and 32. As the films pass, the heated pads 33 of each pair are pressed together, causing the two films to seal against one another in the vicinity of the pads. This action forms a plurality of longitudinal (usually vertical) seals in the film, and a corresponding plurality of film tubes between the longitudinal seals. The discharge tubes 29 are positioned such that they extend through each of the tubes formed at the side seal station 30. Pads 33 are heated using internal heating elements 34 (such as a thermostat and heater cartridge) capable of generating a heat softening effect when the sealing pads 33 of each pair contact a film surface. This heating effect causes a mutual adherence between the two film surfaces when pressure is also applied to such surfaces.

Referring more particularly to FIG. 5, the sealing frames 31, 32 may be placed in either a release (open) or grip (closed) position by manipulating the side seal station shafts 35. The release position is generally utilized when the apparatus is being prepared for use, or when the sealing pads 33 are to release their grips from the film-in such a position, the opposing sealing pads 33 of each sealing frame 31, 32 are removed from close proximity of one another. This permits the operator to insert the films between the first frame 31 and the second frame 32, and place such films into contact with the pull wheel station 40. Once the films are in contact with the pull wheel station 40, the release levers 36 are placed in the operating position. Such position causes the opposing sealing pads 33 of each pair to resume close proximity to one another.

Support shafts 35 of station 30 are mounted to an oscillating or reciprocating mechanism, such as a servo motor system or a cam system 70, so that the entire side seal station 30 is capable of moving along the path of the film for an adjustably measured distance, then backtracking along said path, then following the path again, backtracking, and so on, in a cyclical reciprocating manner. As side seal station 30 travels along the path of the film (at the same speed as the film itself that is being pulled by rollers 43 of pull wheel station 40), the opposing heated sealing pads 33 are brought together, pressing and adhering the film sheets together to form a plurality of vertical seals. Station 30 and pads 33 travel along the film path for a sufficient length of time to fully adhere and seal these vertical sections of the film sheets together. Once this is accomplished, the sealing pads 33 are drawn apart, and station 30 quickly reciprocates upstream along the film path. Then, pads 33 are brought together again, and station 30 again travels with the film along the path to fully adhere the next set of vertical seals which slightly overlap the previous set. This cyclical motion continues for so long as the machine is operating and does not require the rollers 43 to ever stop or pause, thereby allowing for continuous operation.

The vertical length of pads 33 may be modified so as to provide from very short to very long longitudinal seals. An average pad length may be about six or seven inches. It is to be appreciated that film tubes of considerable length may be generated by the machine of the present invention, depending upon when the cross seal and cross cut is eventually employed. It is to be noted that the cyclical oscillating/reciprocating motion of side seal station 30 is independent from that of cross seal station 50 and from that of cross cut station 60, described below.

Figure 6:
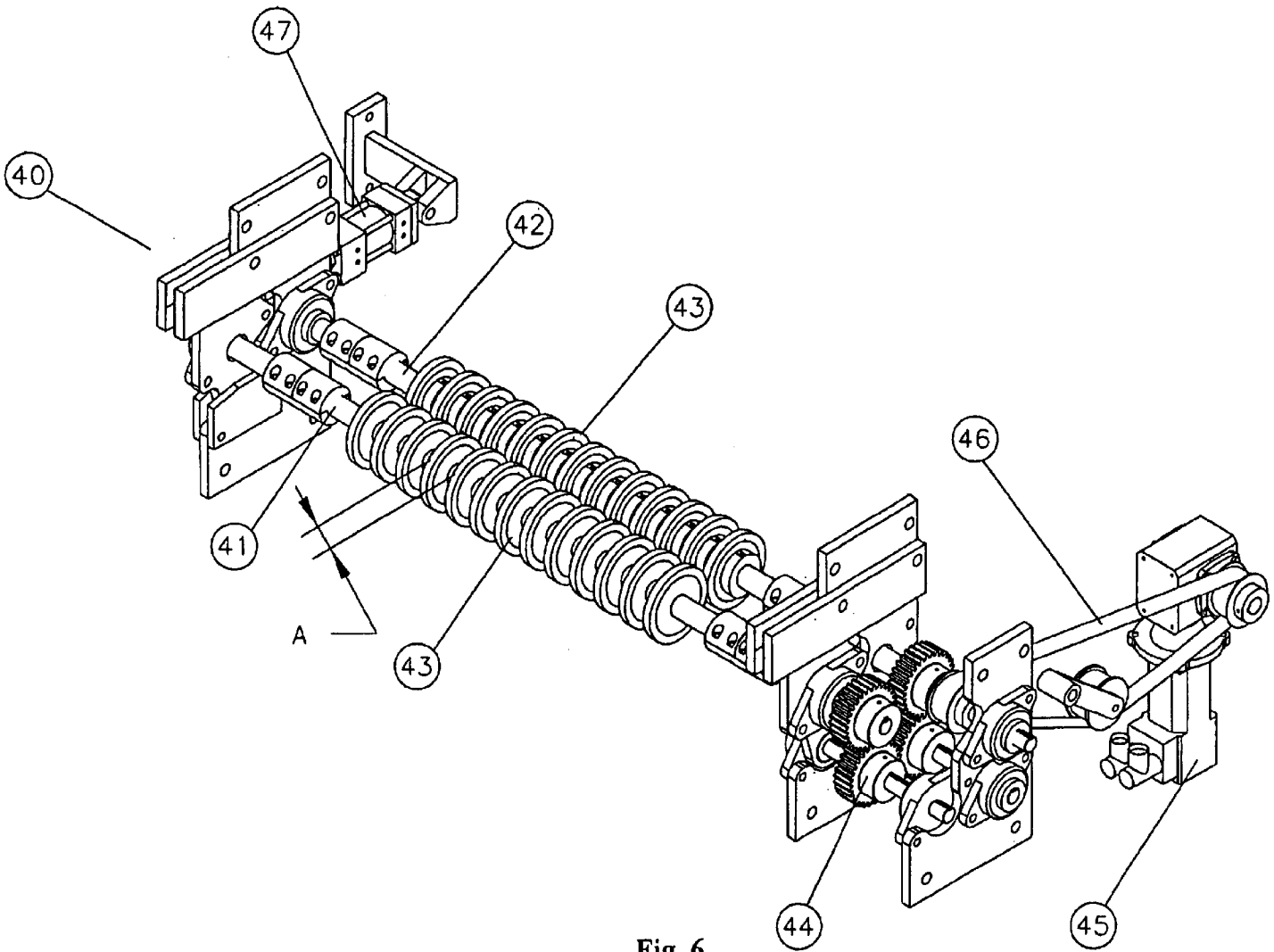
FIG. 6 is an isometric view of a typical pull wheel station of the present invention.

In the preferred embodiment, pull wheel station 40 shown in FIG. 6 follows the side seal station 30 along the film path, as depicted in FIGS. 1 and 2. However, station 40 may be provided at another location along the film path, and/or additional pulling stations such as 40 may also be provided along said path. Just ahead of station 40, a plurality of cutters or blades are provided along the film path for separating the sheet of newly-formed tubes into individual tubes or strips. These cutters are provided at the centers of each of the side seals (except at the extreme outside edge seals where no cut is necessary). As the film is pulled through the machine, these separate tubes or strips are formed.

Referring to FIG. 6, it is seen that pull wheel station 40 includes a first rotatable roller shaft 41 and a second rotatable roller shaft 42, positioned in such a manner that the film advances between first shaft 41 and second shaft 42. A plurality of oppositely positioned rollers 43 are affixed to each shaft 41 and 42, forming a plurality of pairs of rollers. A distance of "A" is provided between adjacent rollers on the same shaft, corresponding to the widths of the pouches to be formed. The two parallel sheets of film are inserted between rollers 43, such that each pair of rollers 43 grips the surface of the adjacent film sheet, drawing the film sheets through the machine, preferably at the same locations as the longitudinal seals. Roller shafts 41 and 42 are preferably operated by a servo motor 45 that is attached by means of a timing belt 46 and gears 44 causing the shafts to rotate in opposite directions of one another. In an alternative embodiment, a cam system 70 may be used to control the motion of shafts 41 and 42. An electronic control receives operator input to automatically adjust the operation of the motors and/or cam system according to the dimensions, contents and other parameters of the pouches to be formed.

Figure 7:
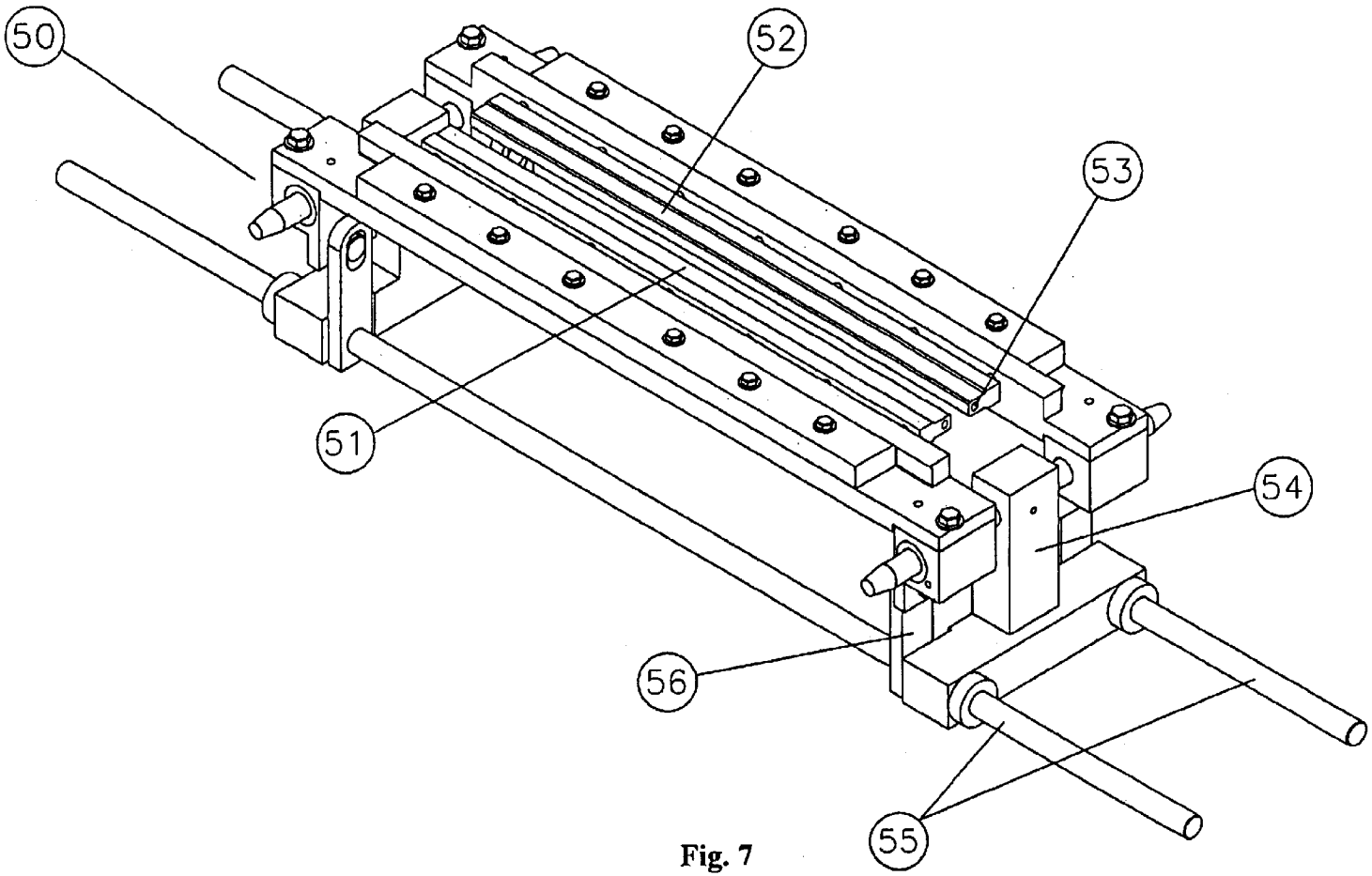
FIG. 7 is an isometric view of a typical cross seal station of the present invention.

Downstream along the film path from the side seal station 30 is the cross seal station 50, shown in FIG. 7. This station 50 includes a first cross sealing pad 51 and an oppositely positioned second cross sealing pad 52. Pads 51 and 52 are positioned so that the two sheets of film advance between them. Each sealing pad 51, 52 houses a heating element 53 capable of generating a heat softening effect when the sealing pad 51, 52 contacts a film surface, such heating effect causing a mutual adherence between the two film surfaces when pressure is also applied to such surfaces. Closing sealing pads 51, 52 causes the pads to contact the film surface, providing a sealing pressure upon the contacted surface areas and bonding them to one another to form a transverse or cross seal (typically horizontal) that is perpendicular to the longitudinal or side seals.

As described with respect to the side seal station 30, cross seal station 50 is also mounted to an independent set of movable shafts 55 that allow the station 50 to move along the path of the film through the machine. Support shafts 55 are mounted to an oscillating or reciprocating mechanism, such as a servo motor system or a cam system 70, so that the entire cross seal station 50 is capable of moving along the path of the film for a measured distance, then backtracking along said path, then following the path again, backtracking, and so on, in a cyclical manner. As cross seal station 50 travels along the path of the film (at the same speed as the film itself that is being pulled by rollers 43 of pull wheel station 40), the opposing heated sealing pads 51, 52 are brought together, pressing the film sheets together to form a transverse (typically horizontal) seal between the sheets. Station 50 and pads 51, 52 travel along the film path for a sufficient length of time to fully adhere and seal this cross section of the film sheets together. Once this is accomplished, the sealing pads 51, 52 are drawn apart, and station 50 quickly reciprocates upstream along the film path. Then, pads 51, 52 are brought together again, and station 50 again travels with the film along the path to fully adhere the next cross seal. This cyclical motion continues for so long as the machine is operating and does not require the rollers 43 to ever stop or pause, thereby allowing for continuous operation.

It is to be noted that the cyclical oscillating/reciprocating motion of cross seal station 50 is independent from that of side seal station 30 described above, and from that of cross cut station 60, described below. This independence is important since, for example, if elongated pouches are to be formed, the sides of such pouches may require several cycles of the side seal station 30 to form the long tubes before a cross seal is required from station 50. The motion of cross seal station 50 may be imparted using servo motors, a cam system 70, or the like.

Once the cross seal has been formed, each product tube or pouch has a sealed bottom and sides. At this point, a measured quantity of the fill product is discharged into each of the tubes from nozzles 29.

Figure 8:
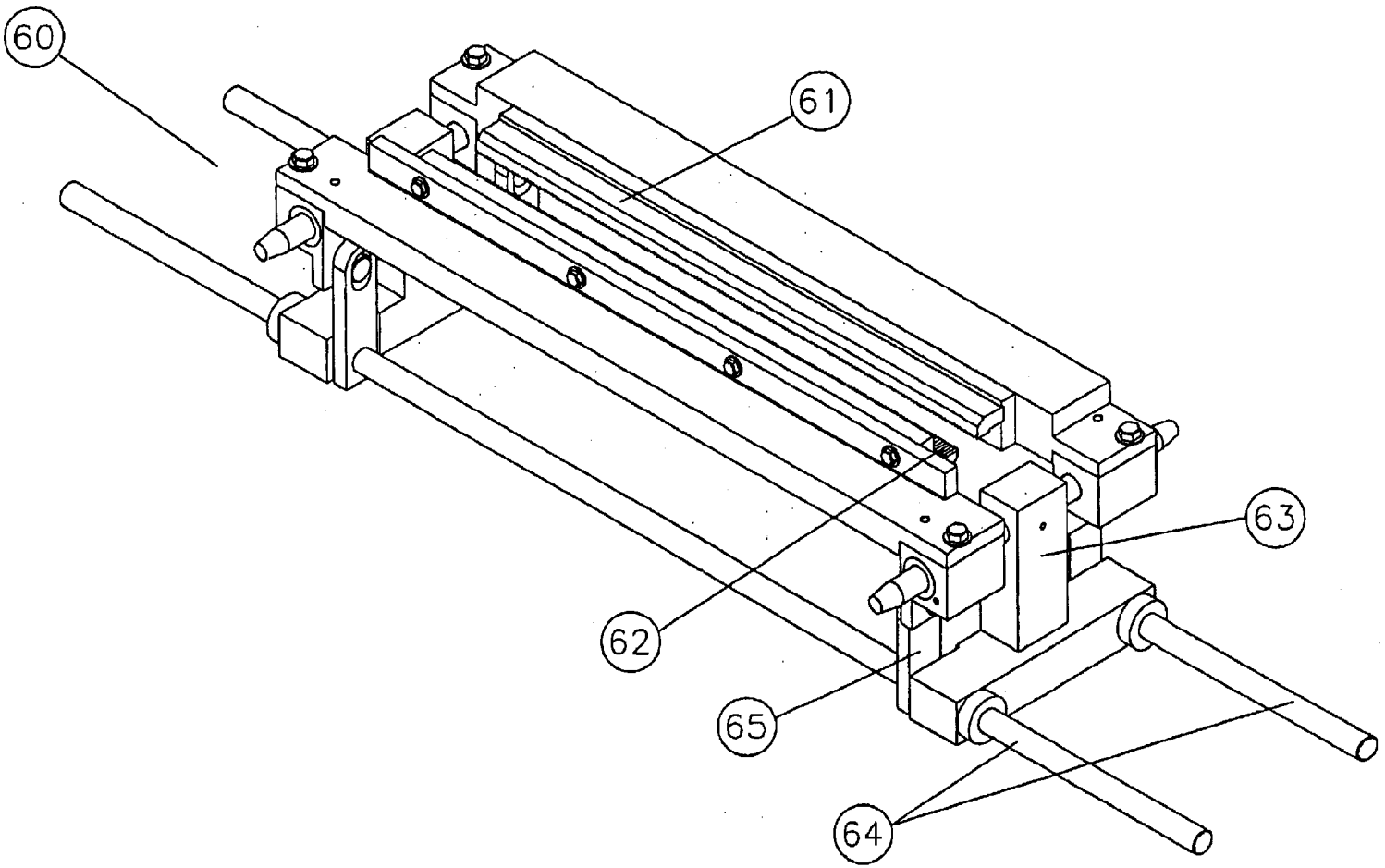
FIG. 8 is an isometric view of a typical cross cut station of the present invention.

Turning to FIG. 8, it is seen that a cross cut station 60 is provided downstream of the film path from the cross seal station 50. Cross cut station 60 includes a cutter such as the illustrated blade 61 and an oppositely positioned receiving plate 62. Blade 61 and plate 62 are positioned in such a manner that the strips of film advance between them. A servo motor, cam system 70, or other motion imparting means is used to cause blade 61 to make contact with, and withdraw from, the receiving plate 62 at a constant rate of speed consistent with the lengths of the rows of film pouches, such that the blade 61 separates rows of pouches from the film by cutting along the midpoint of each transverse seal.

As described above with respect to the side seal station 30 and cross seal station 50, cross cut station 60 is also mounted to a set of movable shafts 64 that allow this station 60 to move along the path of the film through the machine. Support shafts 64 are mounted to an oscillating or reciprocating mechanism, such as a servo motor system or a cam system 70, so that the entire cross seal station 60 is capable of moving along the path of the film for a measured distance, then backtracking along said path, then following the path again, backtracking, and so on, in a cyclical manner. As cross cut station 60 travels along the path of the film (at the same speed as the film itself that is being pulled by rollers 43 of pull wheel station 40), blade 61 and plate 62 are brought together, resulting in a transverse (usually horizontal) cut along the center of the cross seal of the film pouches, dislodging a row of sealed film pouches from the machine. Once this is accomplished, blade 61 is retracted from plate 62, and station 60 quickly reciprocates upstream along the film path. Then, blade 61 and plate 62 are brought together again, and station 60 again travels with the film along the path to make the next cut at the next cross seal. This cyclical motion continues for so long as the machine is operating and does not require the rollers 43 to ever stop or pause, thereby allowing for continuous operation.

It is to be noted that the cyclical oscillating/reciprocating motion of cross cut station 60 is independent from that of side seal station 30, and from that of cross seal station 50, described above. As with cross seal station 50, this independence is important since, for example, a continuous string of several pouches may need to be formed together without being separated from each other. The sides of such strings of pouches may require numerous cycles of the side seal station 30, as well as several cycles from the cross seal station 50 before the specified number of unseparated pouches are formed. At this point, the cross cut is implemented, and strings comprising the designated number of unseparated pouches are discharged from the machine. The motion of cross cut station 60 may be imparted using servo motors, a cam system 70, or the like.

Figure 9:
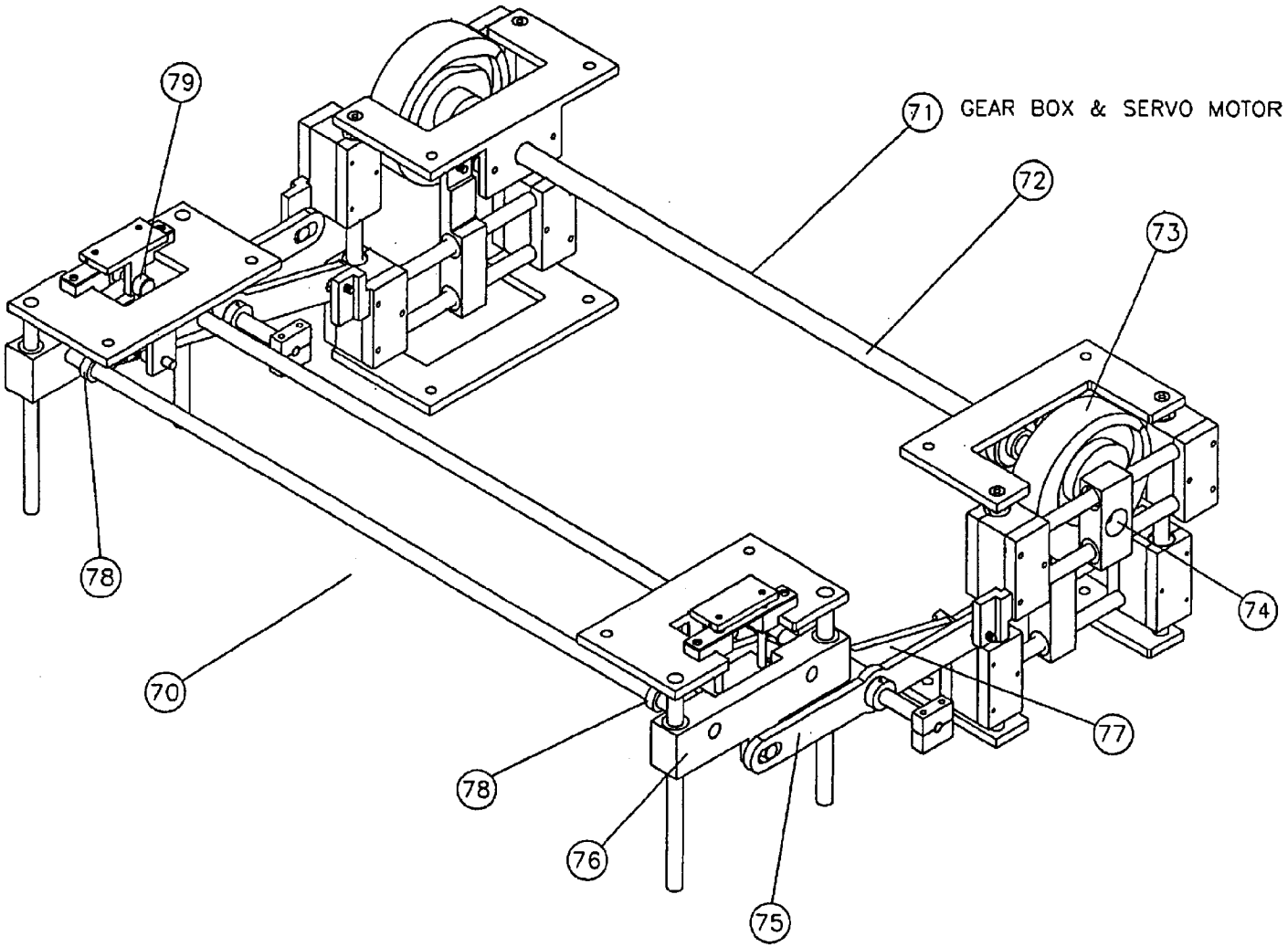
FIG. 9 is an isometric view of a typical the cam system that may be utilized in the present invention.

FIG. 9 illustrates a cam system 70 that may be used as an alternative means of imparting motion to the side seal station 30, cross seal station 50 and/or cross cut station 60. A single cam system may be used to control all three such stations, or up to three separate cam systems 70 may be employed, one for each such station. The cam system 70 comprises a single servomotor 71 (not shown) in communication via shaft 72 to two dual-sided cams 73, levers 75 and the station support mechanism 76. The servomotor 71 provides rotary motion, and cam followers 74 convert this to linear motion. This linear motion provides oscillation to the support shafts 35 of the side seal station, shafts 55 of the cross seal station, and shafts 64 of the cross cut station.

EXAMPLE

For illustrative purposes and by way of example only, and without limiting the scope of the appended claims, the following example is provided. It is assumed that the pouches to be formed will hold ¼ fluid ounce of ketchup, and are to be three inches (3") in length, and one and one-half inch (1½") in width. The film sheets to be used are eighteen inches (18") in width. Such measurements allow twelve (12) film packets per row of film sheet.

Using the exemplary dimensions above, the operator first selects dispensers 22 having a total of twelve output nozzles 24 positioned 1½" apart so that nozzles 24 and extension tubes 29 are located at the center of each 1½" interval. The operator then affixes thirteen side sealing pads 33 to each sealing frame 31, 32 of the side seal station 30, with intervals of 1½" between any two adjacent pads 33. Pads 33 should be 3" in length or greater. For this example, assume pads 33 have a length of seven inches (7"). The operator then makes the necessary adjustments to assure that thirteen rollers 43 are provided on each roller shaft 41, 42 of the pull wheel station 40, and that the rollers 43 are in alignment with each of the side sealing pads 33. The reservoir is filled with ketchup, and the computer control is programmed so that each pump in dispensers 22 of station 20 withdraws ¼ fluid ounce of ketchup from the reservoir during a given stroke.

The oscillation motion, stop and release points of each of the side seal station 30, the cross seal station 50 and the cross cut station 60 are then programmed into the control. It is to be appreciated that these may all be different. In particular, since at least two rows of 3" pouches may be formed with a single cycle of the side seal station 30, it is programmed to oscillate at a rate that is approximately half the oscillation rate of the cross seal and cross cut stations 50, 60. The length of the seal time and speed of the film through the machine is determined by the adhesion characteristics of the film, which also dictates the temperature setting for heated sealing pads 33, 51 and 52. The cycle of station 30 is also established so that there is some overlap of the cross seals in each cycle.

The operator then mounts two foil or film rolls, and feeds the film from both rolls into the machine. The film is advanced through the side seal station 30, the pull wheel station 40, the cross seal station 50, and to the cross cut station 60. The operator then engages the pull wheel station 40 so that rollers 43 grip the film surfaces. This applies pressure to the front and rear surfaces of the film, securely holding the film and allowing it to be advanced automatically through the machine. Elements 34 and 53 are preheated before the rest of the machine is turned on, and the pumps are primed.

The operator then activates the motion imparting mechanism, which may be a plurality of servo motors, or cam systems 70. Such activation causes the pull wheel station 40 to begin advancing film through the machine. The motion imparting system causes the side seal station 30 to initiate an oscillating vertical motion matching the speed at which the film is advanced through the machine. The heating elements 34, and pressure exerted by the sealing pads 33 upon the film causes the formation of a row of thirteen vertical sealed strips upon the film creating the edges of twelve individual film pouches. As the film is pulled through rollers 43, blades above the eleven internal rollers separate the film into twelve separate tubes.

After a minimum of only a partial cycle of the side seal station 30 (since one cycle creates thirteen 7" strips, but the pouches are only to be 3" in length), a first cross seal is made on the film below the pull station 40. This perpendicular seal is made by heated pads 51 and 52 as the cross seal station 50 travels along the film path. Once this seal is made, dispensers 22 insert ¼ ounce of material through each of the twelve nozzles 29 into each of the partially formed pouches. Meanwhile, station 50 retracts to create another cross seal on subsequent film. Below, station 60 performs a cross cut along the cross seal as station 60 travels along the film path, establishing the bottom of the first set of twelve filled pouches. Cross cut station 60 then retracts to perform a subsequent cut.

Meanwhile, side seal station 30 has continued to create thirteen continuous vertical seals on the film (although station 30 cycles only approximately once for each two cycles of stations 50 and 60), and cross seal station 50 has created another cross seal. This seal forms the top of the first row of twelve pouches and the bottom of the next row of twelve pouches. Dispensers 22 again pump material into the second set of twelve partially formed pouches, and cross cut station 60 cuts through the middle of the second cross seal. This second cut releases the first set of twelve completed pouches. All of these operations then continue simultaneously, without stopping or interruption of the advance of film through the machine, creating sets of twelve pouches with each cycle of the cross seal and cross cut stations 50, 60 and pump station 20.

It is to be appreciated that the machine of the present invention is capable of producing pouches of widely ranging dimensions. In particular, pouches formed by the machine may have potentially unlimited lengths, and widths that are only limited by the width of the sheets of film that may be inserted into the machine. Similarly, depending upon the dimensions selected, anywhere from one to over a dozen pouches may be formed from a single row of film material. The same machine may be modified to create, for example, a dozen ½" by 3" pouches per row with one setup (as in the example above), and then adjusted the next day to create, for example, a half dozen 3" by 6" pouches using the same film. Of course, film of different widths may be used to create pouches of different dimensions to avoid waste. Foil, plastic, film or other suitable webbed sheet material may be used to form the pouches of the present invention.

It is preferred that side seal station 30, cross seal station 50 and cross cut station 60 be operated by independent motion imparting means (servo motors, cams, carriages, or the like); however, in some embodiments combinations of some or all of these stations may be operated by the same motion imparting means. The configuration of the cam system may be the same or different on all three stations. Changing the dimensions of the pouches produces and/or the amount of product to be dispensed may be accomplished in the electronic controller which automatically adjusts the electronic cam and/or the servo motors of all stations to adjust their operation timing, allowing for a multitude of pouch sizes and product quantities to be selected for formation and filling by the machine.

The fluid dispensers 22 may be replaced with other dispensers for inserting non-fluid products into the pouches such as salt, pepper, sugar, powdered candy, whole or ground nuts, and the like.

It is to be understood that other variations and modifications of the present invention may be made without departing from the scope thereof. It is also to be understood that the present invention is not to be limited by the specific embodiments disclosed herein, but only in accordance with the appended claims read in light of the foregoing specification.

What is claimed is:

1. A machine for continuously making pouches from a webbed film material and filling said pouches with a product comprising:

a. a support structure on said machine for holding a pair of rolls of said film material;

b. an apparatus for gripping and unrolling film from each of said rolls such that a pair of continuous sheets of film are brought into close proximity with each other along a path through said machine;

c. a plurality of dispensers for inserting product into the pouches as they are being formed;

d. a first station that reciprocates along the path of said film through said machine, said first station supporting a plurality of pairs of opposing closable heat sealing members for imparting a plurality of longitudinal seals upon said pair of sheets of film to bond said sheets together along each of said seals without stopping the movement of film through the machine;

e. a plurality of blades disposed along said path, each such blade being aligned with one of said longitudinal heat sealing members of said first station for separating said sealed film sheets into longitudinal tubular strips;

f. a second station reciprocates along the path of said film through said machine, said second station supporting a pair of opposing closable heat sealing members for imparting transverse seals at spaced intervals upon said pair of sheets of film to bond said sheets together along each of said seals without stopping the movement of film through the machine; and g. a third station that reciprocates along the path of said film through said machine, said third station supporting a blade assembly for cutting across the centers of said transverse seals without stopping the movement of film through the machine.

2. The machine of claim 1 wherein the reciprocating movement of each of said first, second and third stations is independent from the reciprocating movement of each of the other of said stations.

3. The machine of claim 1 wherein said gripping apparatus comprises a pair of moveable parallel shafts, each shaft supporting a plurality of rollers at spaced intervals defining a plurality of pairs of opposing rollers positioned in alignment with said longitudinal heat sealing members of said first station.

4. The machine of claim 1 wherein a plurality of dispensing tubes are provided in operative communication with said dispensers, each of said tubes extending between said sheets of film and through the spaced intervals between the plurality of pairs of rollers.

5. The machine of claim 4 wherein a reservoir of product is provided, and said dispensers include a plurality of pumps for removing measured quantities of product from said reservoir and transferring said quantities through said dispensing tubes into said pouches as they are being formed.

6. The machine of claim 1 wherein said transverse seals are perpendicular to said longitudinal seals.

7. The machine of claim 1 wherein said plurality of blades are provided downstream from said longitudinal heat sealing members.

8. The machine of claim 1 wherein said film support structure is provided on a side of said machine, and a plurality of guides are provided adjacent to said support structure to align and bring the sheets of film from each roll into close parallel proximity with each other prior to entering the machine.

9. An apparatus continuosly for manufacturing and filling webbed pouches comprising:

a. a support means for holding a pair of rolls of webbed film material;

b. a pulling means for gripping and unrolling sheets of webbed film from each of said rolls;

c. a plurality of dispensing means for inserting product into the pouches as they are being formed;

d. a first sealing means that reciprocates along the path of said film through said apparatus for imparting a plurality of longitudinal seals upon said sheets of film to bond said sheets together along each of said seals without interrupting the movement of film through the apparatus;

e. a plurality of cutting means disposed along said path for separating said sealed film sheets into longitudinal tubular strips;

f. a second sealing means that reciprocates along the path of said film through said apparatus for imparting transverse seals at spaced intervals upon said pair of sheets of film to bond said sheets together along each of said seals without interrupting the movement of film through the apparatus; and g. a transverse cutting means that reciprocates along the path of said film through said apparatus for cutting across the centers of said transverse seals without interrupting the movement of film through the apparatus.

10. The apparatus of claim 9 wherein the reciprocating movement of each of said first sealing means, said second sealing means and said transverse cutting means is independent from the reciprocating movement of each of the other of said means.

11. The apparatus of claim 9 wherein said pulling means brings a pair of continuous sheets of film from said rolls into close proximity with each other along a path through said apparatus.

12. The apparatus of claim 9 wherein said first sealing means supports a plurality of pairs of opposing closable heat sealing means, and each of said cutting means is aligned with one of said pairs of closable means.

13. The apparatus of claim 12 wherein said pulling means comprises a pair of moveable parallel shaft means, each shaft supporting a plurality of roller means at spaced intervals defining a plurality of pairs of opposing roller means positioned in alignment with said heat sealing means.

14. The apparatus of claim 9 wherein a plurality of dispensing tube means are provided in operative communication with said dispensing means, each of said tube means extending between said sheets of film and through the spaced intervals between the plurality of pairs of roller means.

15. The apparatus of claim 14 wherein a reservoir of product is provided, and said dispensing means include a plurality of pump means for removing measured quantities of product from said reservoir and transferring said quantities through said tube means into said pouches as they are being formed.

16. The apparatus of claim 9 wherein said transverse seals are perpendicular to said longitudinal seals.

17. A method for continuously forming and filling sealed pouches from webbed film material comprising the steps of:

a. unrolling sheets of said webbed film from a pair of rolls, and guiding said sheets so that they travel in a parallel relationship in close proximity to each other along a path;

b. forming at least two continuous longitudinal seals along said film sheets such that said sheets are bonded together at said seals using a first moveable sealing apparatus that reciprocates along the path of said film without interrupting the movement of said film along said path;

c. cutting said sealed film sheets into strips along said longitudinal seals;

d. forming cross seals at pre-determined intervals on said film sheets such that said sheets are bonded together at said cross seals using a second moveable cross sealing apparatus that reciprocates along the path of said film without interrupting the movement of said film along said path;

e. inserting a measured quantity of product material between the film sheets and between said longitudinal seals following the formation of each cross seal; and f. cutting said film along each of said cross seals using a second cutting apparatus that reciprocates along the path of said film without interrupting the movement of said film along said path.

18. The method of claim 17 wherein the reciprocating movement of each of said first moveable sealing apparatus, said second moveable sealing apparatus and said second cutting apparatus is independent from the reciprocating movement of each of the other of said apparatus.

19. The method of claim 17 wherein said cross seals are perpendicular to said longitudinal seals.

20. The method of claim 17 wherein said film sheets are cut into strips along said longitudinal seals using a plurality of blades located downstream from said first moveable sealing apparatus.

21. An apparatus for continuously manufacturing, filling and sealing webbed pouches comprising:

a. a support structure for holding a pair of rolls of webbed film material;

b. a pulling device for gripping and unrolling sheets of webbed film from each of said rolls;

c. a plurality of dispensers for inserting product into the pouches as they are being formed;

d. a first sealer that reciprocates along the path of said film through said apparatus for imparting a plurality of longitudinal seals upon said sheets of film to bond said sheets together along each of said seals without interrupting the movement of film through the apparatus;

e. a plurality of cutters disposed along said path for separating said sealed film sheets into longitudinal tubular strips;

f. a second sealer that reciprocates along the path of said film through said apparatus for imparting transverse seals at spaced intervals upon said pair of sheets of film to bond said sheets together along each of said seals without interrupting the movement of film through the apparatus; and g. a transverse cutting device that reciprocates along the path of said film through said apparatus for cutting across the centers of said transverse seals without interrupting the movement of film through the apparatus.

* * * * *